United States Patent [19]

Burkhardt et al.

[11] 3,987,638

[45] Oct. 26, 1976

[54] SUBSEA STRUCTURE AND METHOD FOR INSTALLING THE STRUCTURE AND RECOVERING THE STRUCTURE FROM THE SEA FLOOR

[75] Inventors: Joseph A. Burkhardt, New Orleans; William D. Loth, Covington, both of La.; Martin O. Pattison, Palos Verdes Estates, Calif.

[73] Assignee: Exxon Production Research Company, Houston, Tex.

[22] Filed: Oct. 9, 1974

[21] Appl. No.: 513,429

[52] U.S. Cl. ..... 61/88; 61/1 F; 61/97; 61/50; 61/69 R; 166/.5; 175/9

[51] Int. Cl.[2] ..... E21B 43/01; B01D 19/00

[58] Field of Search ..... 61/46.5, 50, 69; 175/6, 175/7, 8, 9, 10; 166/.5, .6

[56] References Cited

UNITED STATES PATENTS

| | | | |
|---|---|---|---|
| 3,113,699 | 12/1963 | Crawford et al. | 61/46.5 X |
| 3,186,487 | 6/1965 | Geer et al. | 166/.5 |
| 3,430,695 | 3/1969 | Hubbard | 166/.5 |
| 3,633,667 | 1/1972 | Falkner, Jr. | 166/.5 |
| 3,754,380 | 8/1973 | McMinn et al. | 166/.5 |
| 3,877,520 | 4/1975 | Putnam | 166/.6 |
| 3,881,549 | 5/1975 | Thomas | 166/.5 |

*Primary Examiner*—Jacob Shapiro
*Attorney, Agent, or Firm*—John S. Schneider

[57] ABSTRACT

A structure or template forms a tubular support structure for subsea equipment used in drilling and producing offshore oil and/or gas wells. The template contains production manifolding, remote and safety shut-in control, pump-separator, and pipeline connector subsystems. Certain of the structural tubes are segregated to form compartmented ballast chambers capable of being selectively flooded and dewatered. Certain other structural tubes form piling sleeves. The truss or framework of structural tubes include vertical and horizontal tubes, the latter forming circumferential members as well as interstitial supports. The uppermost of the circumferential members or "ring" also functions as a fender to protect the equipment within the template. The template is made negatively buoyant upon launch by flooding the compartmented ballast chambers, keelhauled (swung to a position underneath the keel of the drilling vessel), and then lowered to the subsea floor. Once it is positioned on the sea floor the subsea structure is oriented, pile founded and leveled. The template functions as a drilling and casing guide frame ensuring that drilled wells are connectable to the preinstalled manifolding. The template is recoverable by severing the piles and deballasting the compartmented ballast chambers.

24 Claims, 34 Drawing Figures

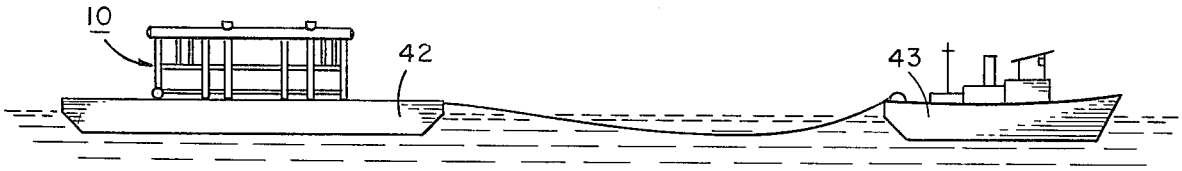
FIG. 5.
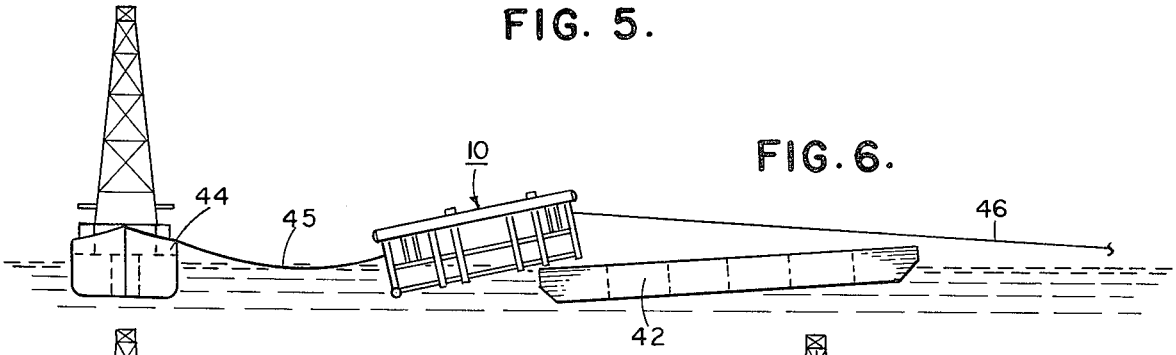
FIG. 6.
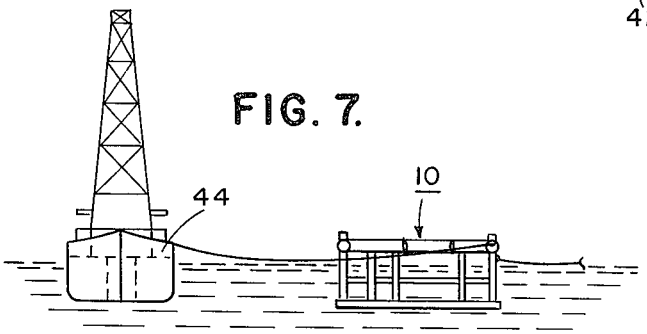
FIG. 7.
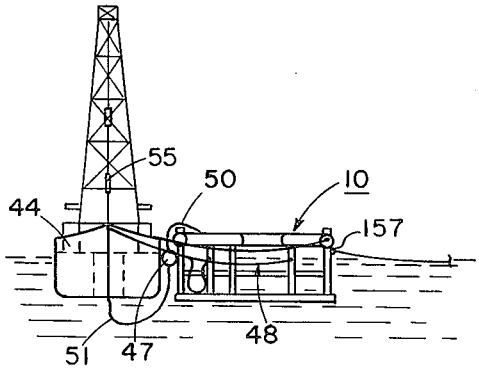
FIG. 8.
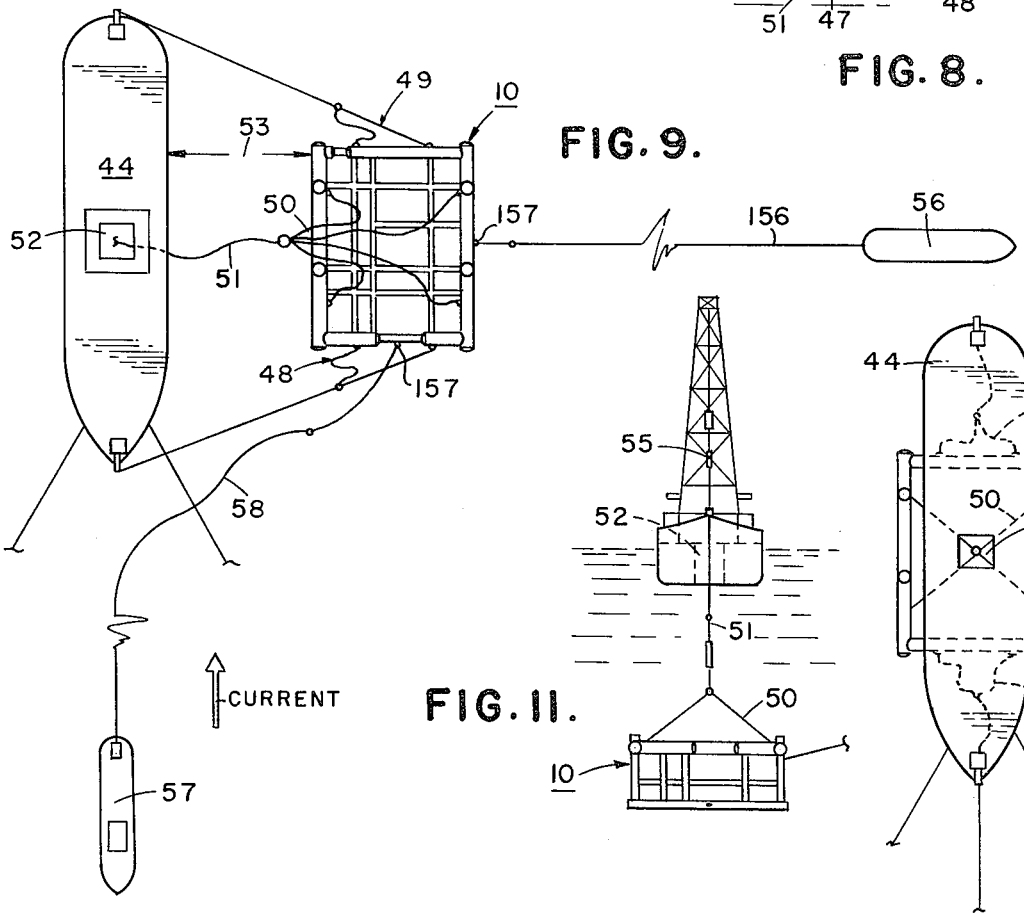
FIG. 9.
FIG. 11.
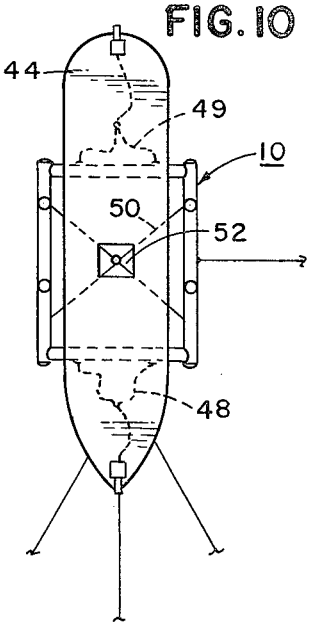
FIG. 10

33
90a
90a
33
13
85
85
86
85
32
89
90
91
91
87c
18
18
90
87a
87b
LIFTING TOOL 87
86c
87a
87
87b
86c 15
80
15
HANG OFF TOOL 79
SPACER PIPE 76
90a
87d
90a
80
79

85
86
17
17
33
85
33
GUARD FENDER 13
32
10
75
70
SLIPS 74
RETAINER BASKET 73
PILING 70
OVER-FLOW SLOTS 32a
32a
PILING SLEEVE 32

SPACER PIPE 76
75
77
SLIP UNIT 74
70
PLASTIC PIPE 78

PLASTIC PIPE 78
RETAINER BASKET 72
70
78
CEMENT SHOE 71

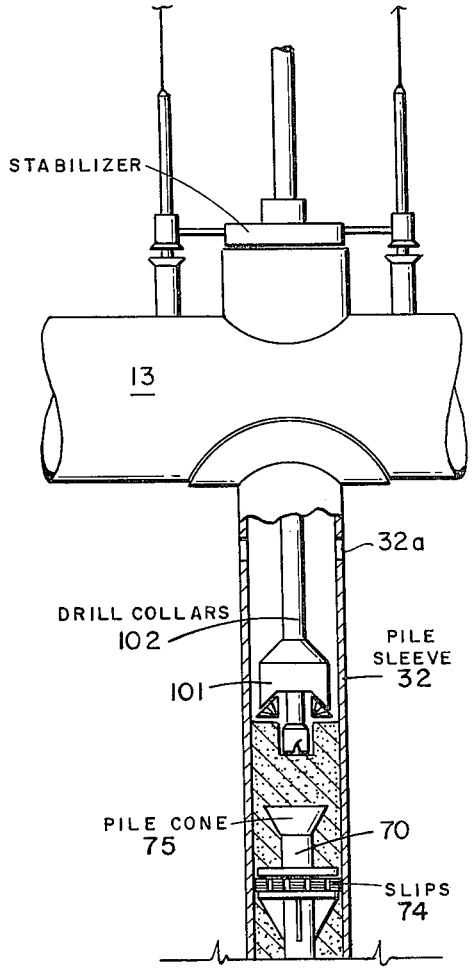
FIG. 26.
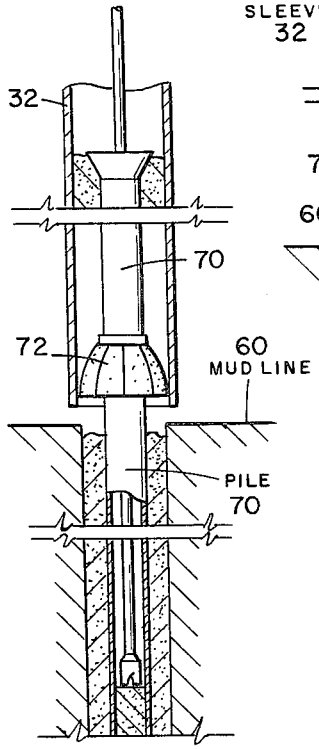
FIG. 27.
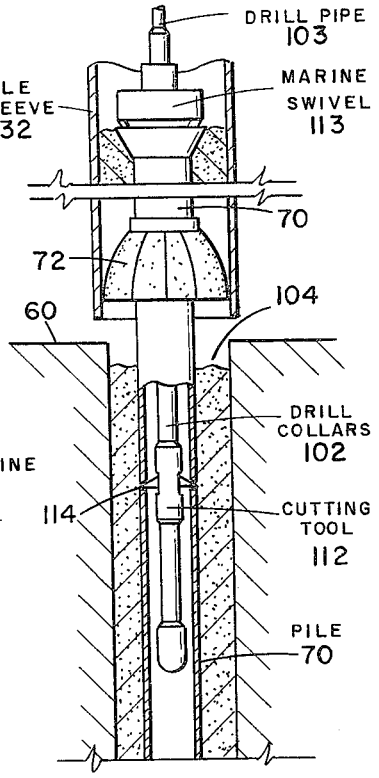
FIG. 28.
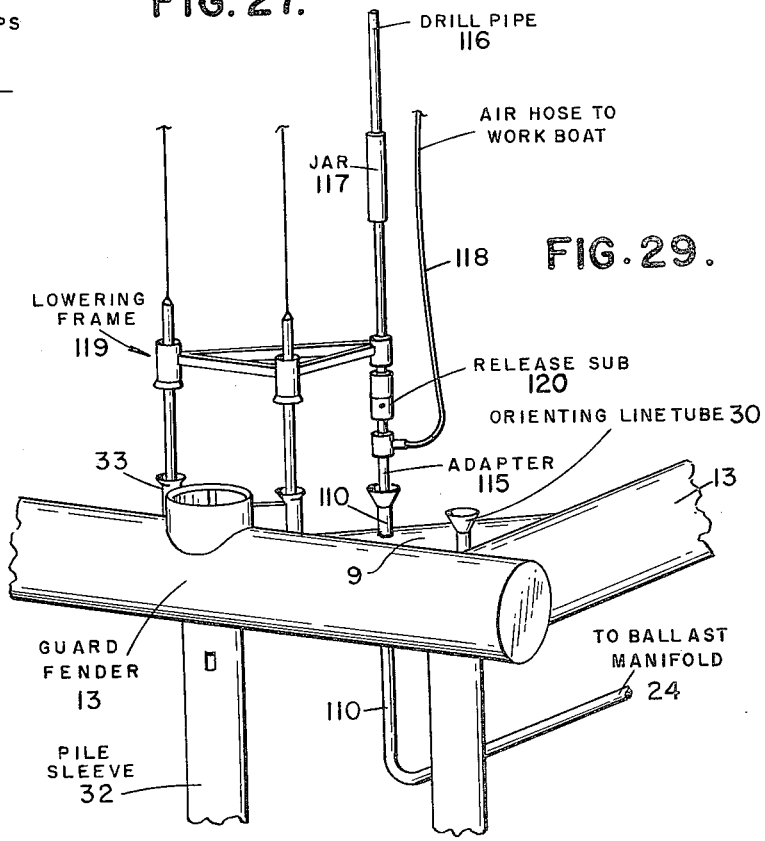
FIG. 29.
FIG. 30.
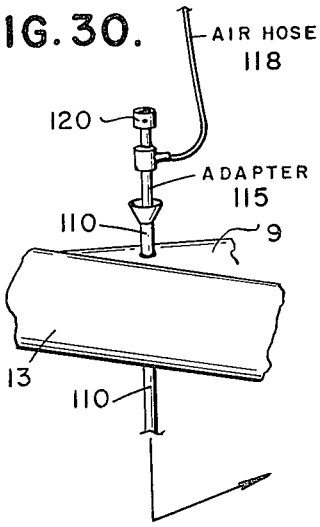

SUBSEA STRUCTURE AND METHOD FOR INSTALLING THE STRUCTURE AND RECOVERING THE STRUCTURE FROM THE SEA FLOOR

BACKGROUND OF THE INVENTION

The present invention concerns, broadly, maneuvering large and heavy equipments onto and form the sea floor. More particularly, the invention concerns a support structure for use in drilling and completing subsea oil and/or gas wells and methods for installing the structure on and removing the structure from the sea floor. As drilling and production water depths increase beyond the point of optimum diver utilization placing such structures on and removing such structures from the ocean floor must be conducted remotely from a floating vehicle. Motions induced by wind, wave and current create vessel-equipment interactions which, if not properly controlled, can render conventional handling techniques worthless. In addition, such structure placement and removal operations should include utilization of a minimum number of marine vessels, the ability to work under normal weather conditions, a relatively rapid completion of the operations to preclude extended waits for lengthy periods of good weather, and the ability to place the structure in the correct geographical location and attitude. The structure should also be designed for easy installation, should be capable of withstanding the abnormal rigors of sea floor existence, and should be retrievable at the conclusion of its working life. The structure and method of the present invention meet all of the aforementioned requirements.

SUMMARY OF THE INVENTION

The present invention involves a subsea structure which comprises a plurality of horizontal and vertical structural tubes arranged to provide support for the subsea oil and/or gas drilling and production equipment. Certain of the tubes are segregated to form compartmented ballast chambers or tanks capable of being selectively flooded or dewatered to achieve desired negative or positive buoyancies, respectively, so that the weight of the submerged structure can be controlled to facilitate carrying out the various required operations. The elevated location of the uppermost circumferential ring makes it very useful in generating a large water plane area for yielding excellent floating stability and provides, also, a high center of buoyancy in the submerged conditions which also contributes to stability. In addition, this ring serves as a fender to protect the equipment surrounded by the ring from damage by dragging anchors or other submerged objects. Selected vertical structural tubes form pile sleeves used in securing the structure to the sea floor. Guide means are provided on the ring to aid in guiding equipment into the pile sleeves. Such equipment aids in anchoring the subsea structure to the sea floor and for releasing the subsea structure from the sea floor. Orienting tubes are mounted on the periphery of the subsea structure through which lines are extendible to a surface drilling vessel and to surface working vessels. The drilling and production equipment on the subsea structure includes a track for a manipulator which surounds a series of well bays, or antipollution pan, flowline valves, a framework for flowline connectors, electrical-hydraulic units, a separator and pump unit and a buoyancy control manifold having floor and vent lines extending to the ballast chambers.

The method involved in maneuvering the subsea structure to install it on the sea floor comprises the steps of towing the structure to adjacent a drilling vessel; connecting lines between the vessel and the structure and the structure and one or more working vessels, ballasting to trim the structure level at the surface; ballasting the structure to a negative buoyancy; keelhauling the structure to beneath the drilling vessel; lowering the structure to the sea floor; orienting the structure geographically; pile founding the structure onto the sea floor; cementing the piles in the sea floor and then leveling the structure. The structure is removable by severing the piles and dewatering the structure to make it positively buoyant.

BRIEF DESCRIPTION OF THE DRAWINGS

FIGS. 5 to 11, inclusive, illustrate schematically towing the subsea structure into the launch area, launching the structure from the tow barge into the water, connecting the structure to the drilling vessel and then keelhauling the structure to a position for lowering it to the sea floor;

FIGS. 26 to 33 illustrate schematically the steps employed in removing the subsea structure from the ocean floor.

DESCRIPTION OF THE PREFERRED EMBODIMENTS

Figure 1:
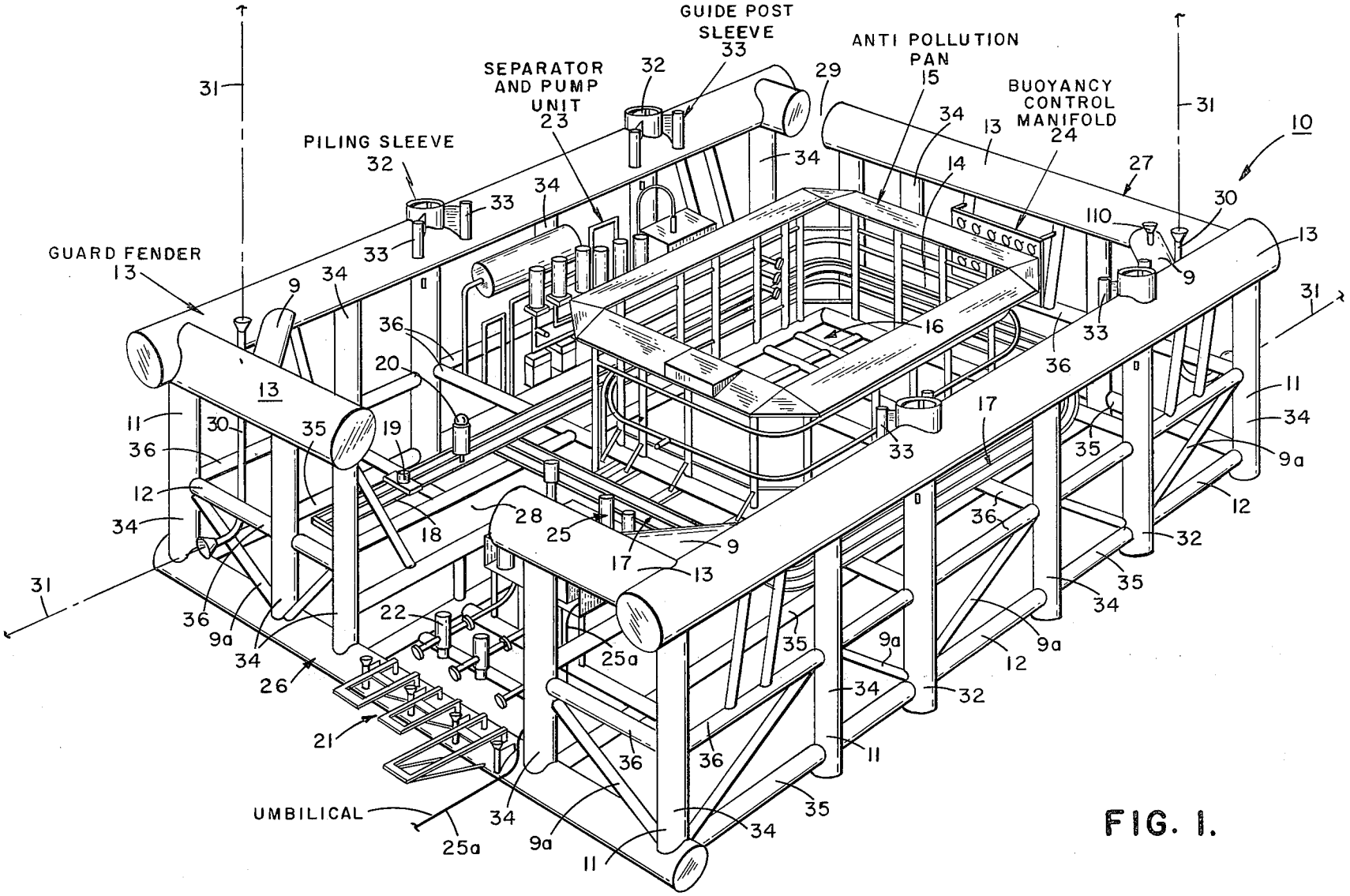
FIG. 1 is a schematic perspective view of the subsea structure of the invention.
Figure 1A:
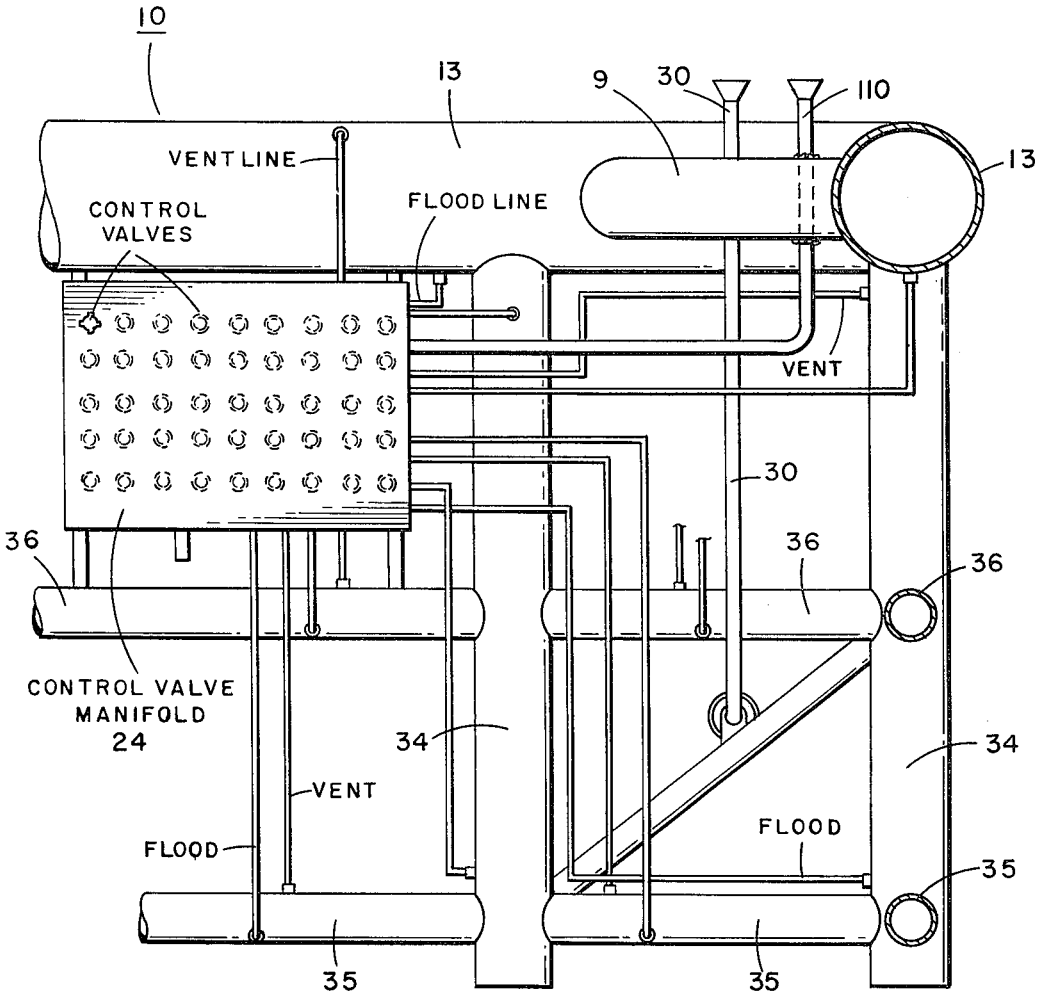
FIG. 1A is a fragmentary view illustrating buoyancy control means.

As shown in FIGS. 1 and 1A, a large boxlike structure or template 10 designated for subsea use in drilling and producing submerged oil and/or gas wells includes a truss or framework of interconnecting vertical and horizontal steel tubular members 11 and 12, respectively, which are segregated to form compartmented tanks which function as ballast chambers, and other steel tubular members, which form pile sleeves 32 and cross support members 9 and 9a. The large uppermost circumferential tubular members 13 also form a protective ring or guard fender for the equipment supported on structure 10. That equipment includes production manifolding 14 on which is mounted an antipollution pan 15 and which surrounds a number of well bays 16, a track 17 surrounding the production manifolding and having a straight track section 18 on which is positioned an anchor 19 for a manipulator and a releasable buoy 20 for use in guiding the manipulator to the track, framework 21 for flowline connectors, flowline valves 22, a separator and pump unit 23, a buoyancy control manifold 24, floor (water) and vent (air) lines connected to buoyancy control manifold 24 and the ballast chambers, deballast tube 110 mounted on one of the corner support tubes 9, and an electric-hydraulic unit 25. As shown particularly in FIGS. 1 to 4 template 10 is rectangularly shaped and has a bow 26 and a stern 27. A space 28, is formed in the bow side of tubular ring 13 to accommodate flowline connector apparatus and a space 29, is formed in the stern side of tubular ring 13 to accommodate a power cable which extends from the surface to the separator and pump unit 23. Power for control system purposes is delivered through a separate umbilical cable 25a extending through space 28.

Two L-shaped orienting tubes 30, each having funneled ends and each being located in opposite diagonal corners of template 10, are used in orienting template 10 and orienting line 31 is threaded through each of the orienting tubes 30 as shown.

Four of the vertical tubular members 32 form pile sleeves. Adjacent each pile sleeve are two guide post sleeves 33.

Vertical tubular members 34 at the extremities of template 10 are flooded as necessary to level the template while it is floating at the surface to ensure that it will submerge level. Preselected portions of the lower horizontal tubular members 35 are flooded to change the template from a positive to a negative buoyancy at which buoyancy the weight is maintained at a sufficiently low value to permit handling of the template by conventional apparatus. Thus, the template will remain at such negative buoyancy during lowering apparatus, orienting, pile setting, cementing and leveling. Divers operate the valves on the buoyancy control manifold to control the ballasting operations while the template is at or near the water's surface prior to lowering it to the sea floor. Tubular members not flooded prior to or during the keelhauling and the change from positive to negative buoyancy, including centrally located members 36 and buoyancy or fender ring 13, are flooded after template 10 is on bottom, leveled and piles set. The manipulator operates the valves on the buoyancy control manifold to control fill and vent operations once the template is positioned on the sea floor. Upon an acoustic command from the surface vessel, a buoy is released from the template and the manipulator which is positively buoyant upon launch hauls itself down, lands, and latches on the track encircling the manifold. Once latched on the track the manipulator is in a position to remove malfunctioning parts of, install replacement parts of and resurface carrying used components of the pretested equipment initially installed on the template.

Figure 2:
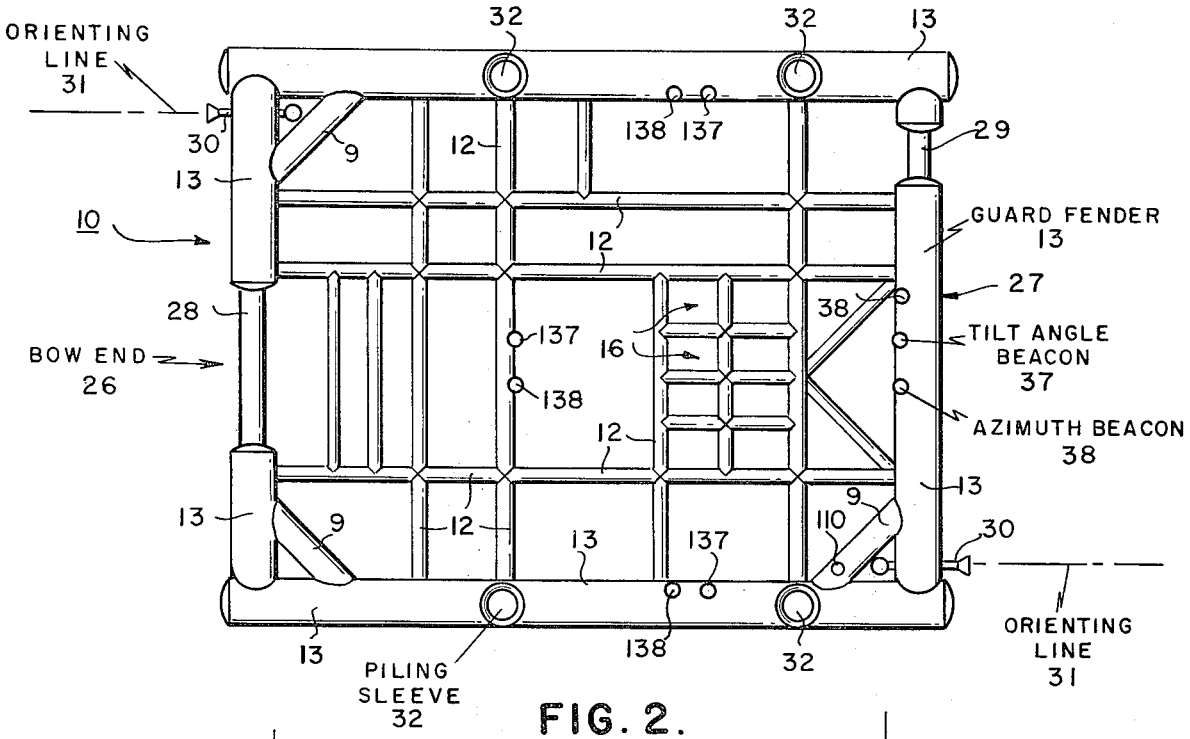
FIGS. 2, 3 and 4 are respectively plan, side and front views of the subsea structure of FIG. 1.
Figure 3:
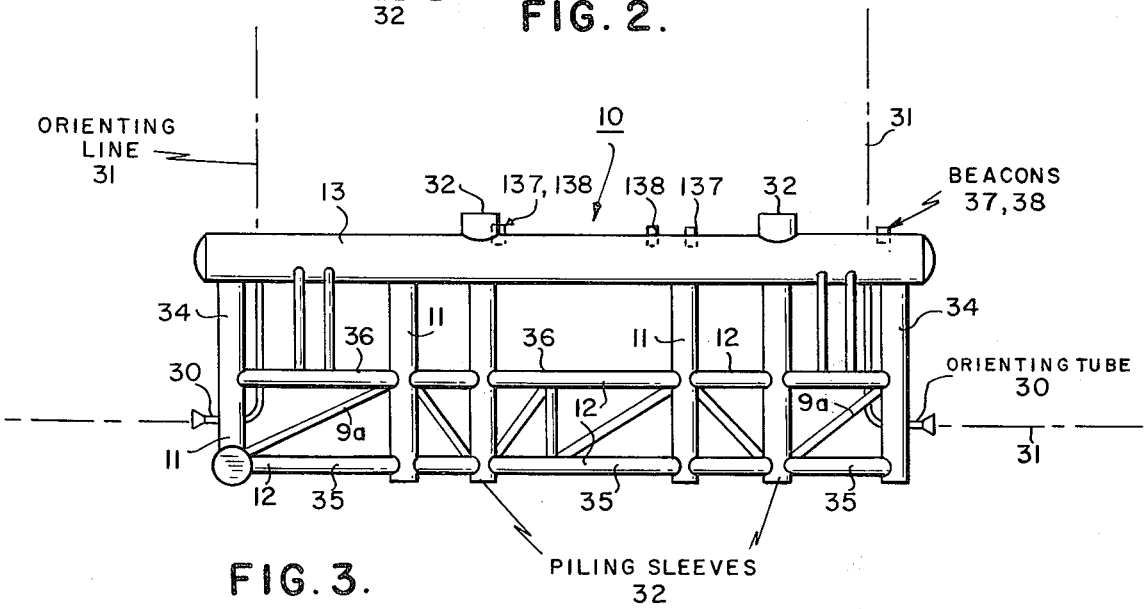
Figure 4:
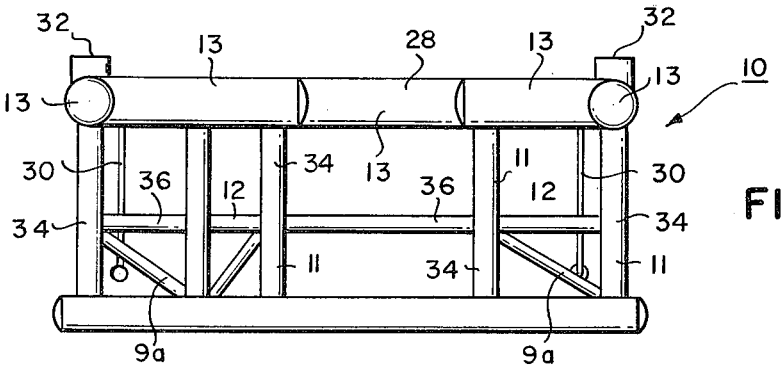

As shown in FIGS. 2 and 3 more particularly a single tilt angle beacon 37 used to measure the angular displacement of template 10 during leveling is positioned in an array with two locator beacons 38 which are used to measure azimuth. Alternative similar arrays are shown and may be desirable as spares to forestall replacement delays on deep-water systems. A backup hardware telemetry system 137, 138 is also shown.

FIG. 5 shows template 10 being towed on a barge 42 by a vessel 43 to the site of launch. As seen in FIG. 6 template 10 is connected to a drilling vessel 44 by a control line 45 and to a work boat, not shown, by another control line 46. As indicated, end tanks of barge 42 are flooded to permit template 10 to slide into the water. In the position shown in FIG. 7 the vertical trim tanks 34 are flooded, as necessary, to level template 10 at the water's surface. As seen in FIG. 8 template 10 is warped alongside drilling vessel 44. Pneumatic bumpers 47 are positioned between template 10 and drilling vessel 44. Keelhaul bridles 48 and 49 are connected to the bow and stern of the drilling vessel and to the bow and stern of the template. The warping lines are removed and the main lowering sling assembly 50 is attached to template 10. The main line 51 of sling assembly 50 is keelhauled through the drilling well (moonpool) 52 of drilling vessel 44 and connected to a preferably heave-compensated hook 55 (as indicated in FIG. 8) in the derrick. One work boat 56 pulls template 10 away from drilling vessel 44 a specified distance 53 to permit template 10 to swing under and clear vessel 44 as it is submerged. A work boat 57 may be connected to template 10 by line 58 and it may proceed upstream to a current control anchor if local current conditions demand such additional control. Anchors are set in a line suitable for azimuth positioning of template 10 utilizing winches on drilling vessel 44. FIGS. 10 and 11 show template 10 in position for lowering relative to drilling vessel 44. The weight of the template as it swings under drilling vessel 44 is supported by lowering sling assembly 50. Template 10 is raised slightly by line 51 and sling assembly 50 and keelhaul lines 48 and 49 are removed.

Figure 12:
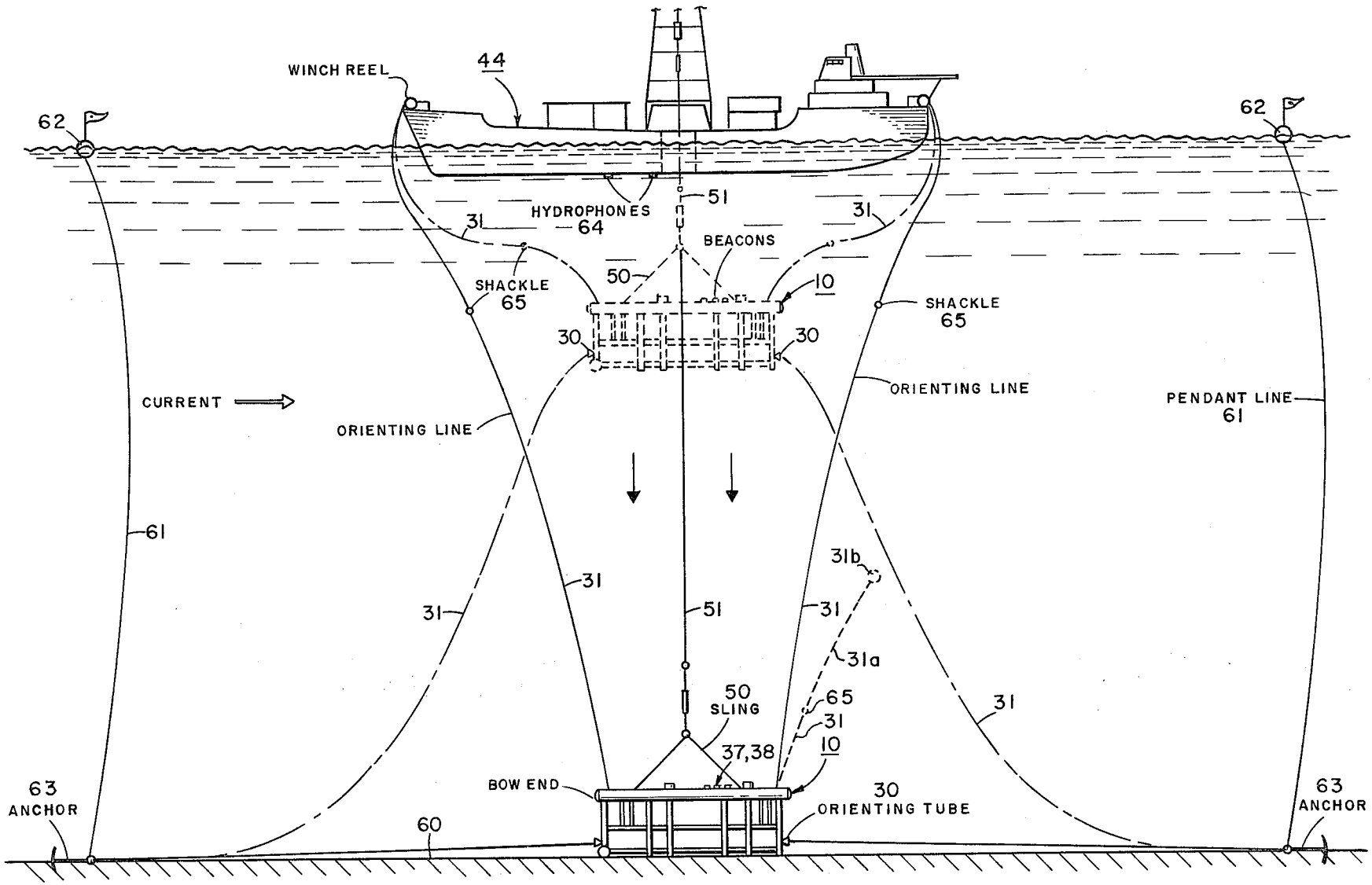
FIG. 12 is a schematic illustration of the lowering of the subsea structure to the sea floor.

FIG. 12 shows the relationship between drilling vessel 44 and template 10 as it is lowered through the water to the subsea floor 60. The lines from anchors 63 which are the aforementioned orienting lines 31 are taken from the work boats and passed through orienting tubes 30 bow and stern of the template and connected to winches on the bow and stern on drilling vessel 44. A pendant line 61 connected to a buoy at the surface is connected to each anchor 63 as shown. Hydrophones 64 located on the underside of drilling vessel 44 in association with beacons 37 and 38 continuously monitor the azimuth positions as the template is lowered through the water. Azimuth readings are made just before setting the template on the ocean floor. Tensioning or orienting lines 31 can rotate template 10 to the desired orientation at which point template 10 can be set on the ocean floor.

When properly landed lowering sling assembly 50 may be removed from template 10 by hydraulic lines connected to pelican hooks (not shown) on the sling or by mechanical release cables (not shown) operated from drilling vessel 44. Control lines 156 and 58, if used, are removed by running go-devils down the lines to releasable connection 157 for retrieval by the work boats. Orienting lines 31 are retrieved by picking up anchors 63 with pendant lines 61 and moving towards template 10 while reeving in lines 31 with winches mounted on drilling vessel 44. As shackle 65 reaches drilling vessel 44 the upper segment of line 31 will be replaced with a synthetic fiber rope 31*a*. The work boat will then proceed away from template 10 drawing orienting line 31 back down through orienting tube 30. Line 31 will be tensioned with line 31a so as not to foul template 10. As line 31 clears the template 10, line 31a will be jettisoned with buoy 31b attached to prevent line 31a from fouling the template. As buoy 31b impinges on orienting tube 30, tensioning line 31a will be strained and parted. Lines 31a and 31 will then be retrieved by work boat as will be buoy 31b.

The heading for the drilling vessel mooring is chosen to accommodate current and sea conditions at the launch site. The drilling vessel should be aligned with the surface current during kneelhauling. Selection of the drilling vessel's heading is made to permit turning the vessel in its moorings during placement of the template to accommodate variables of current, wind, etc. Anticipation of such variables will establish whether the drilling vessel is moored bow or stern to the current and the relative position of the template.

Figures 13, 14, 15, 16, 17, 18:
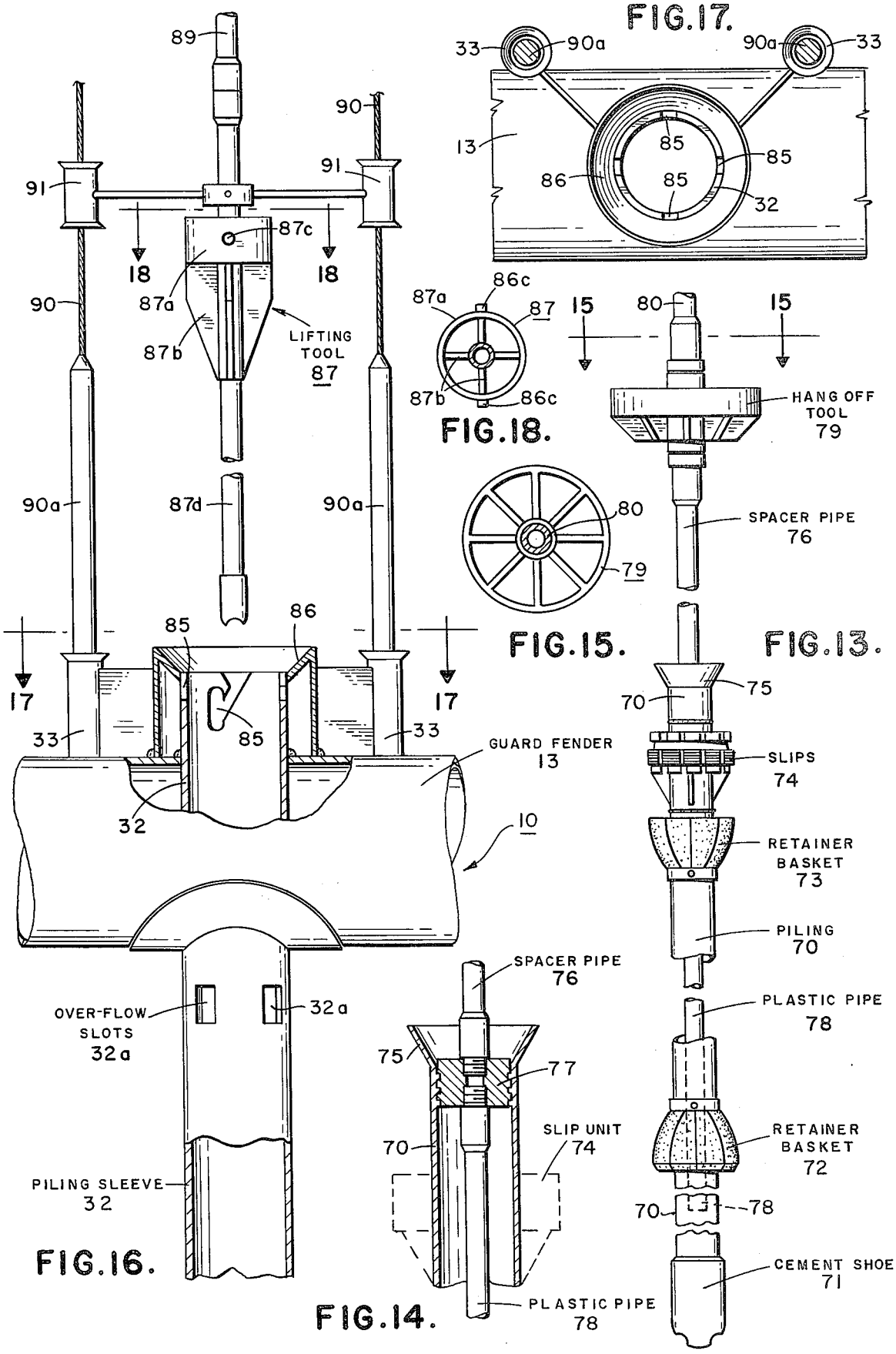
FIGS. 13 to 15 inclusive illustrate the pile and means associated therewith for placing the pile ine position and for cementing thereof.
FIGS. 16 to 18 illustrate the pile sleeve and lifting tool for leveling the subsea structure.

Referring to FIGS. 13, 14 and 15 and with particular reference to FIG. 13 there is shown the pile to be inserted into and through piling sleeve 32 and the means attached to the pile 70 for placing and cementing pile 70 in place. Piling 70 includes a cementing shoe 71, a lower retainer basket 72, an upper retainer basket 73, slips 74 and an upper funnel-shaped end 75. A spacer pipe 76 is connected into a collar 77 (see FIG. 14) to which is connected a length of plastic pipe 78 which extends down through piling 72. Spacer pipe 76 has mounted on it a hang-off tool 79 to which is attached drill pipe 80.

Referring now to FIGS. 16 to 18 in which the lifting tool for leveling the template is shown in operating position relative to the pile sleeve. Piling sleeve 32 has overflow slots 32*a* positioned just below buoyancy and fender ring 13. The top of pile sleeve 32 is provided with two sets of J-slots 85 and a pile sleeve guide cone 86. The purpose of the overflow slots are to prevent cement slurry from spilling over on production and other equipments 14–24 and from entering the upper end of the piling sleeve adjacent the J-slots. A lifting tool 87 having a sleeve portion 87*a* and tapered plate members 87*b* thereon is attached to drill pipe 89. A pair of J-lugs 87*c* positioned 180° apart are fixed on and extend outwardly from sleeve portion 87*a*. A stringer or pipe 87*d* extends downwardly from the lower end of tool 87. Plate members 87*b* guide and center the tool 87 into the cone-shaped top 86 of pile sleeve 32 and allow the lugs 87*c* to engage J-slots 85. Guide cables 90 extend to the surface from guide posts 90*a* positioned in sleeves 23 and guide frame members 91 positioned about the cables 90 and connected to lifting tool 87 guide the lifting tool down into pile sleeve 32. On larger templates only three leveling pile sleeves may be used with several non-leveling pile sleeves.

Figures 19, 20, 21, 22, 23, 24, 25:
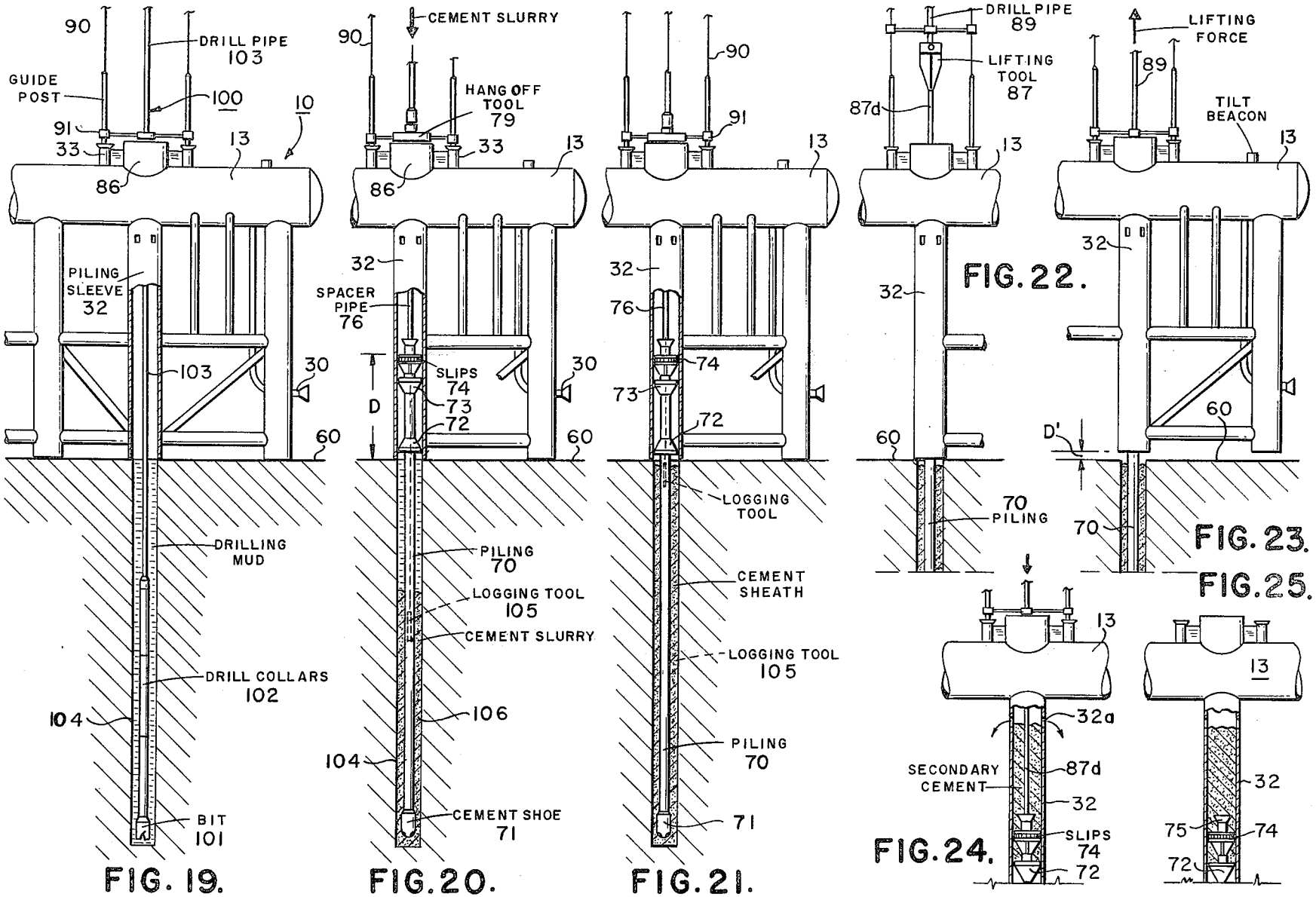
FIGS. 19 to 25 illustrate schematically the steps employed in cementing the piling in the ground underlying the water and in cementing the piling in the piling sleeve.

The cementing and leveling operations are illustrated in FIGS. 19 to 25 inclusive. Referring to FIG. 19 operations are begun on the lowest sleeve as indicated by tilt beacon 37. A drill string 100 including a drill bit 101, drill collars 102 and drill pipe 103 is guided from drilling vessel 44 into pile sleeve 32 by means of the guide means 91 and cables 90 and the pile hole 104 is drilled to a desired depth. The hole is conditioned by displacing seawater with viscous drilling fluid to preserve the hole. The drill string is then recovered to the drill vessel. As illustrated in FIGS. 10 and 21 the pile assembly shown in FIG. 13 is run into the pile hole through the pile sleeve on drill pipe until hang-off tool 79 reaches pile cone 86. Slips 74 engage the inner wall of pile sleeve 32 and allow upward movement of piling sleeve 32 but prevent downward movement thereof. Spacer pipe (drill pipe) 76 positions the top of the pile or slips a distance D (approximately 10 feet) above the bottom of pile sleeve 32. The spacer pipe 76 connects into pile sleeve 32 by means of the adaptor collar 77 (FIG. 14) which is threaded into pile 70 by left-hand threads. Plastic pipe section 78 extends from the underside of the adapter collar 77. The upper and lower retainer baskets 73 and 72, respectively, prevent primary cement from entering the pile sleeve annulus and the secondary cement from going below retainer basket 73. Plastic pipe 78 permits the primary cement slurry to remain free of seawater as it is pumped down the drill pipe and through the plastic pipe. In the event the plastic pipe becomes cemented in it can be twisted off when the adapter and drill pipe are removed and left in piling 70. A logging tool 105 (or detector) is run through the drill pipe and through the piling assembly to detect cement as it passes uphole in the piling annulus 106. The cement slurry is mixed with radioactive material in the first batch thereof sufficient to provide a reading on the detector when the cement passes the detector and also when it moves up in the annulus 106. This assures as that the slurry is not being lost to formations. Cement is then pumped down the drill pipe and through the piling and the cement shoe as illustrated in FIGS. 24 and 25 until the cement is just below the top of hole 104 as indicated by raising logging tool 105. The cement is then permitted to set and the drill pipe and adapter plus the plastic pipe, if not cemented in, are removed from the hole. If the plastic pipe is cemented in then it is twisted off and left in the pile.

As illustrated in FIGS. 22 and 23 lifting tool 87 is run on drill pipe with a stinger and stabbed into pile sleeve 32 to engage lugs 87*c* into J-slots 85. The drill pipe is then pulled up to raise the lowest corner of template 10 while taking readings indicated by tilt beacon 37. After each upward movement of the template the tilt beacon is allowed to steady and is again read. The template pile sleeve is raised until template 10 is as near level as can be achieved with the first or lowest sleeve 32. As shown in FIG. 23 the first sleeve 32 has been raised a distance D'. Lifting tool 87 and drill pipe 89 are then removed. The pipe slips 74 will support the template 10 in this position. The same operations are then performed on the next lowest pile sleeve 32 as indicated by the tilt beacon readings. The procedure for leveling is repeated for each remaining pile sleeve until the template is level.

FIGS. 24 and 25 illustrate the secondary cementing procedure. Secondary cementing is begun in the last pile used to level template 10. Cement is pumped through the drill pipe connected to the lifting tool through the lifting tool and into the top of piling 70 from which the secondary cement overflows and fills the upper end of pile sleeve 32 until the cement flows out slots 32*a* in the pile below the fender ring 13. Cement also surrounds slips 74 and the upper portion of piling 70 down to the top of retainer basket 73. The cement is permitted to equalize and then the J-tool and pipe are raised up and flushed with seawater. Then a bailer is run through the drill pipe to detect and sample the top of the cement. The secondary cementing operations are repeated on each of the remaining pile sleeves. The secondary cement acts as a plug in the top of the pile sleeve and above the pile and also acts as a backup for slips 74. The secondary cement permits recovery of the upper portion of the piles 70 and slip units 74 when the template is salvaged after its use in that particular location has terminated. In addition, the secondary cement prevents the template from moving off piles 70 during deballasting operations when cutting or severing the piles as hereinafter described.

After all of the piles have been set and cemented in, tubular structure members thus far remaining dry on the template can be flooded to bring the template to full submerged weight. Drilling of the wells through the well bays in the template is commenced and completion and production operations are carried out.

The remaining FIGS. concern salvaging the template. The wells are plugged and the well casings are cut loose from the submerged production system equipment on template 10. Referring to FIG. 26 then the secondary cement is drilled out of pile sleeve 18 to adjacent the top of pile 70 in the pile sleeve which is nearest to the deballasting tube 110 (see FIG. 29) which connects to the ballast manifold 24. The pile is then drilled out to 10 feet below the cutoff point of the pile as illustrated in FIG. 27. The drill pipe is then pulled and a cutting tool assembly 112 on which is mounted a marine swivel 113 for seating in pile cone 75 is run into pile 70 and the pile is cut off as indicated at 114. The drill pipe 103 and cutting tool 112 attached to it are then pulled.

Before proceeding to cut a second pile deballasting operations are begun. Referring to FIG. 29 a compressed air adapter stab unit 115 is connected to the lower end of a drill pipe 116 (which contains a jar 117 just above adapter 115) on the drilling vessel. The air hose 118 to the work boat is keelhauled from the compressor on the work boat under the drilling vessel through the moon well and attached to the adapter unit then the adapter 115 and drill pipe 116 are lowered together with guide frame 119 and the adapter is stabbed and locked into the deballast tube 110. Air is then pumped through tube 110 to the buoyancy control manifold 24 and then to the ballast tanks formed by the tubular members to force water out of them. A release sub 120 contains a shear pin. That shear pin is sheared by jar 117 to release the drill pipe connection from the adapter 115 and the drill pipe 116 is removed. As seen in FIG. 30 the air continues to deballast the ballasting tanks.

Then the diagonally positioned pile sleeve 32 and the pile therein are drilled out as discussed above and the pile is cut and removed in the same manner as discussed above.

Figure 31:
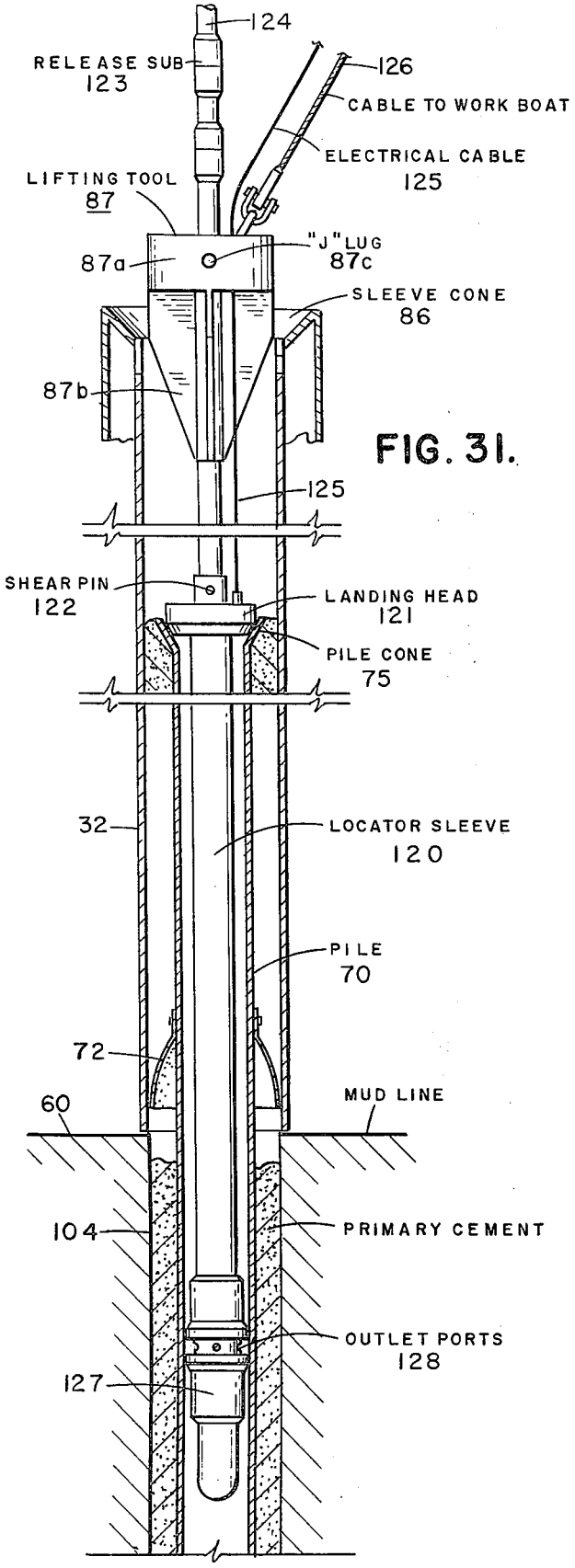
Figure 32:
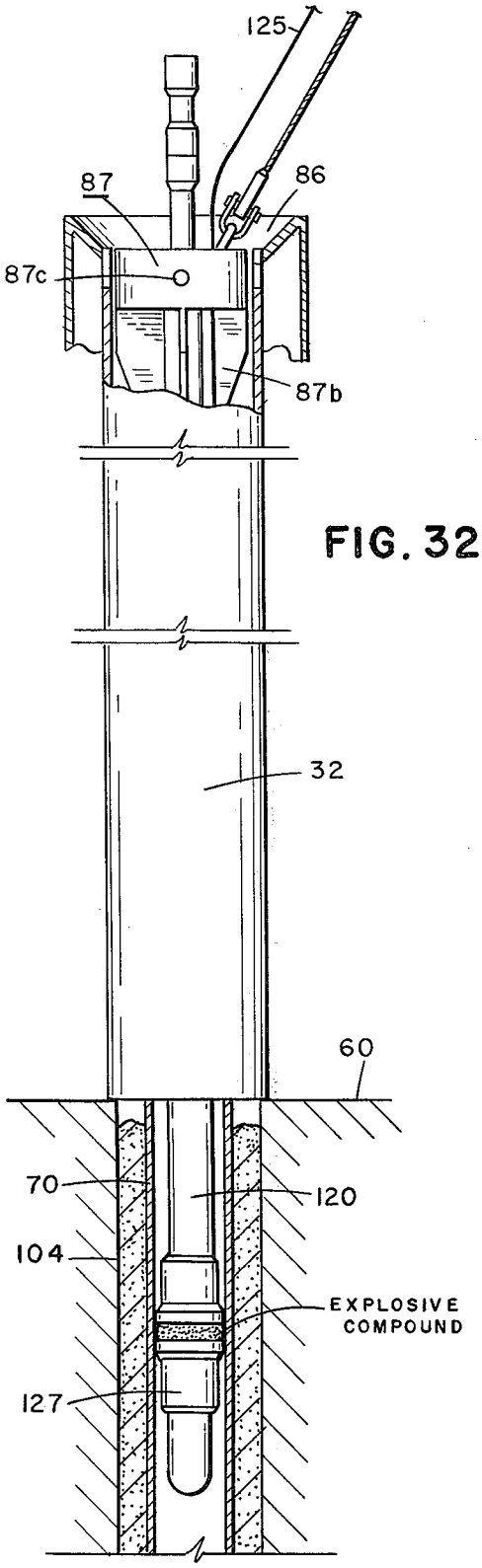

The remaining two piles are preferably cut explosively. Referring to FIGS. 31 and 32 after drilling out the cement as described above a telescoping tool or locater sleeve 120 provided with at its upper end a landing head 121 and having a shear pin connection 122 to the lower end of lifting tool 87 to which is connected a release sub 123 on drill pipe 124 is run into pile 70 until landing head 121 lands on the pile cone 75 as shown. An electrical cable 125 extends from the work boat into the locater sleeve 120 and a cable 126 connects the lifting tool to the work boat. A sub 127 on the locater sleeve 120 is provided with outlet ports 128. Locater sleeve 120 contains an explosive compounds such as a plastic explosive compound. The locater sleeve 120 positions the outlet ports at the desired cutoff point in pile 70. After head 121 lands in cone 75 pin 122 is sheared and lifting tool 87 is lowered until lugs **86*c* on the lifting tool are locked in the J-slots of the pile sleeve. This downward movement forces the explosive compound through the ports into direct contact with the inner wall of pile sleeve 32. Such telescopic movement also arms the unit for firing. The explosive compound is moved through outlet ports 128 as indicated in FIG. 32. Thereafter the drill pipe 124 is released from sub 123 above lifting tool 87. A similar operation is performed in the diagonally positioned pile sleeve, i.e. the pile sleeve is cleaned out and another locater sleeve containing explosive is run into that pile. Both the electric cable and the other cable 126** are connected at the surface to a second work boat.

Figure 33:
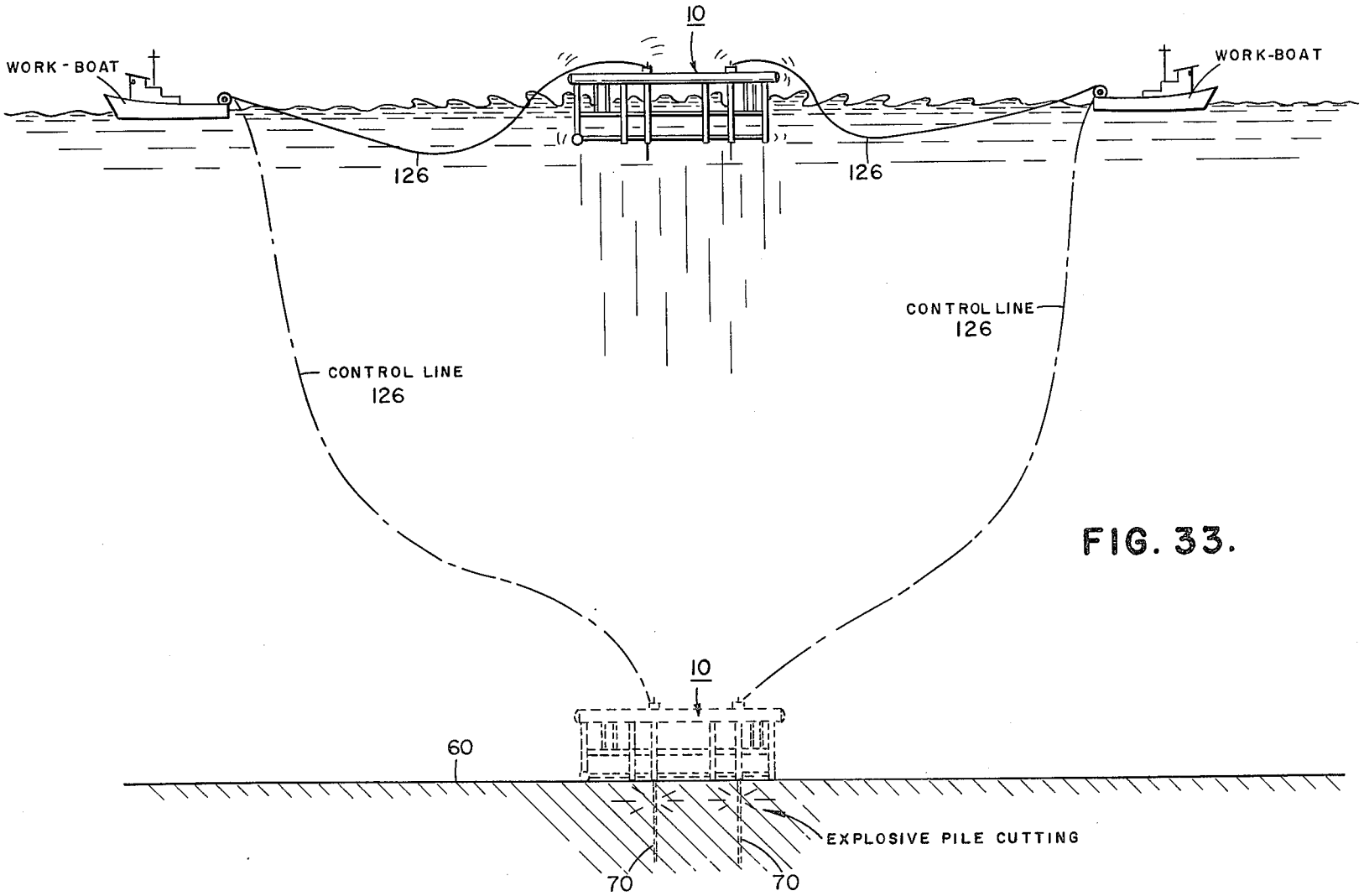

Deballasting operations are halted. The drilling vessel is removed from the area. The deballasting is brought to a desired state. The charges are fired remotely from the work boats at short intervals. The released template is controlled by control lines and the work boats. As shown in FIG. 33 the template rises to the water surface. When template 10 is afloat all the valves are manually closed by divers and the template is towed to port.

Changes and modifications may be made in the specific illustrative embodiments of the invention shown and/or described herein without departing from the scope of the invention as defined in the appended claims. Thus, as mentioned previously, instead of four piles two or three piles or more than four piles may be used. In addition, the manner of ballasting and deballasting the manifold may vary according to desired operations. Further the manner of salvaging the template may be changed. All of the piles may be explosively cut or all may be mechanically cut.

Having fully described the method, apparatus, objects and advantages of our invention we claim:

1. A subsea structure comprising:

interconnected vertical and horizontal structural tubes to form a box-like framework support for subsea oil and/or gas drilling and production equipment;

certain of said horizontal tubes forming peripheral rings on said framework;

said vertical and horizontal tubes being segregated to form compartmented ballast chambers capable of being flooded and dewatered;

said tubes of said uppermost ring being larger than said other tubes and having at least a part thereof extending outwardly of said other tubes to provide a fender to protect said drilling and production equipment;

at least two of said vertical structural tubes forming pile sleeves;

guide means on said structural tubes for guiding equipment into said pile sleeves for installing piles to anchor said subsea structure on the sea floor and for releasing said subsea structure from the sea floor;

said tubes providing both floating and submerged stability; and beacons and/or other means of telemetry mounted on said tubular members for communicating with a surface drilling vessel to determine and provide information to the surface concerning tilt of said subsea structure and the azimuth thereof.

2. A structure as recited in claim 1 including orienting means arranged on said structure through which lines are extendible to a surface drilling vessel above said subsea structure and surface working vessels outboard of said drilling vessel.

3. A structure as recited in claim 2 wherein said subsea structure is generally rectangular, said orienting means comprising two means, each diagonally opposite the other.

4. A structure as recited in claim 3 wherein said drilling and production equipment includes electrohydraulic units, framework for flowline connectors, flowline valves, separator and pump unit, production manifolding, well bays, an antipollution pan, buoyancy control manifolds, compressors, power generators, and other oil/gas production apparatus.

5. A method for maneuvering large subsea structures comprising the steps of:

arranging said structure to float in water adjacent a drilling vessel;

connecting lines between said vessel and said structure;

keelhauling said structure to beneath said vessel; ballasting said structure to level it in the water; lowering said structure to the sea floor;

geographically orienting said structure prior to placement on the sea floor;

sinking piles through said structure to anchor it to the sea floor;

cementing said piles in place; and leveling said structure.

6. A method as recited in claim 5 including said steps of:

severing said piles;

deballasting said structure; and floating said structure to the water's surface.

7. A subsea structure comprising:

a plurality of horizontal and vertical structural tubes arranged to provide support for subsea oil and/or gas drilling and production equipment;

certain of said tubes being segregated to form compartmented ballast chambers capable of being selectively flooded or dewatered to achieve desired negative or positive buoyancies for said structure;

certain other of said structural tubes forming pile sleeves;

said horizontal tubes forming peripheral circumferential ring members as well as interstitial supports; and the uppermost of said ring members being larger than said other ring members to provide a large water plane area for floating stability and to provide, also, a high center of buoyancy for submerged stability; at least a part of said uppermost ring member extending outwardly of said other ring members to provide a fender to protect equipment surrounded by said uppermost ring member from damage by submerged objects.

8. A structure as recited in claim 7 including guide means on said structural tubes for guiding equipment into said piling sleeves for installing piles to anchor said subsea structure on the sea floor and for releasing said subsea structure from the sea floor.

9. A structue as recited in claim 8 including telemetry means mounted on said tubular members for communicating with the water surface to determine and provide information to the surface concerning tilt of said subsea structure and the azimuth thereof.

10. A structure as recited in claim 9 including orienting means arranged on said structure; and orienting lines extending through said orienting means to the surface.

11. A structure as recited in claim 10 wherein said subsea structure is generally rectangular and said orienting means comprises two such means each diagonally opposite the other.

12. A structure as recited in claim 11 wherein said drilling and production equipment includes electrohydraulic units, framework for flowline connectors, flowline valves, separator and pump unit, production manifolding, well bays, an antipollution pan, buoyancy control manifolds, compressors, and power generators.

13. A method for maneuvering large subsea structures comprising the steps of:

arranging said structure to float in water adjacent a drilling vessel;

ballasting said structure to trim said structure level at the water surface;

ballasting said structure to a negative buoyancy;

keelhauling said structure to beneath said drilling vessel;

lowering said structure to the sea floor; and orienting said structure geographically.

14. A method a recited in claim 13 including pile founding said structure onto the sea floor; and cementing said piles in the sea floor.

15. A method as recited in claim 14 including leveling said structure.

16. A method as recited in claim 15 including:

severing said piles;

deballasting said structure; and floating said structure to the water surface.

17. A method for maneuvering a large subsea structure comprising the steps of:

arranging said structure to float in water adjacent a drilling vessel;

connecting lines between said vessel and said structure;

keelhauling said structure to beneath said vessel;

ballasting said structure to level it in the water;

lowering said structure to the sea floor;

geographically orienting said structure prior to placement of it on the sea floor;

sinking piles through said structure to anchor it to the sea floor;

cementing said piles in place;

leveling said structure; said structure including cylindrical pile sleeves located at peripheral points on said structure through which said piles are sunk; the steps of cementing said piles in place and leveling said structure including:

lowering a drill string containing a drill bit through the lowest one of said pile sleeves and drilling a pile hole to a desired depth;

removing said drill string and drill bit to said vessel;

lowering a first pipe containing slips into said pile hole through said pile sleeve and engaging said slips with the inner wall of said pile sleeve to permit upward movement of said pile sleeve but not downward movement thereof relative to said first pipe;

pumping cement down said first pipe and up the annulus of said pile hole surrounding said first pipe until said cement is just below the bottom of said pile sleeve;

removing the upper portion of said first pipe above said slips to said vessel;

lowering a second pipe containing a lifting tool into said pile sleeve and engaging the lifting tool with said pile sleeve;

pulling up on said second pipe to raise said pile sleeve and thereby said structure until said structure is as near level as can be achieved;

removing said lifting tool and said second pipe;

repeating the above cementing and leveling operations on each of said other pile sleeves until said structure is level; and pumping cement through the second pipe into the top of each of said pile sleeves until cement fills said pile sleeves.

18. A method as recited in claim 17 including:

conditioning said pile hole by displacing seawater with viscous drilling fluid to preserve said pile hole prior to the step of removing said drill string and drill bit to said vessel; and running a logging tool through said first pipe to detect cement as it moves uphole in the first pipe-pile hole annulus, said cement containing radioactive material sufficient to provide a reading on a radioacitve detector logging tool.

19. A method as recited in claim 17 including the steps of:

drilling out cement in each of said pile sleeves;

cutting off each of said pile sleeves;

deballasting said structure; and floating said structure to the water surface.

20. A method as recited in claim 19 in which said structure is rectangular and said pile sleeves are positioned at each corner of said rectangle and including the steps of:

drilling out cement in two of the diagonally positioned pile sleeves and then cutting off those pile sleeves;

initiating deballasting of said structure;

drilling out cement in the remaining two pile sleeves;

locating explosive compounds at the point of severance of said other two pile sleeves and then explosively severing said other two pile sleeves; and floating said structure to the water's surface.

21. A method as recited in claim 15 in which said structure includes cylindrical pile sleeves located at peripheral points on said structure through which said piles are sunk and the steps of cementing said piles in place and leveling said structure include:

lowering a drill string containing a drill bit through the lowest one of said pile sleeves and drilling a pile hole to a desired depth;

removing said drill string and drill bit to said vessel;

lowering a first pipe containing slips into said pile hole through said pile sleeve and engaging said slips with the inner wall of said pile sleeve to permit upward movement of said pile sleeve but not downward movement thereof relative to said first pipe;

pumping cement down said first pipe and up the annulus of said pile hole surrounding said first pipe until said cement is just below the bottom of said pile sleeve;

removing the upper portion of said first pipe above said slips to said vessel;

lowering a second pipe containing a lifting tool into said pile sleeve and engaging the lifting tool with said pile sleeve;

pulling up on said second pipe to raise said pile sleeve and thereby said structure until said structure is as near level as can be achieved;

removing said lifting tool and said second pipe;

repeating the above cementing and leveling operations on each of said other pile sleeves until said structure is level; and pumping cement through the second pipe into the top of each of said pile sleeves until cement fills said pile sleeves.

22. A method as recited in claim 21 including:

conditioning said pile hole by displacing seawater with viscous drilling fluid to preserve said pile hole prior to the step of removing said drill string and drill bit to said vessel; and running a logging tool through said first pipe to detect cement as it moves uphole in the first pipe-pile hole annulus, said cement containing radioactive material sufficient to provide a reading on a radioactive detector logging tool.

23. A method as recited in claim 21 including the steps of:

drilling out cement in each of said pile sleeves;

cutting off each of said pile sleeves;

deballasting said structure; and floating said structure to the water surface.

24. A method as recited in claim 23 in which said structure is rectangular and said pile sleeves are positioned at each corner of said rectangle and including the steps of:

drilling out cement in two of the diagonally positioned pile sleeves and then cutting off those pile sleeves;

initiating deballasting of said structure;

drilling out cement in the remaining two pile sleeves;

locating explosive compounds at the point of severance of said other two pile sleeves and then explosively severing said other two pile sleeves; and floating said structure to the water's surface.

* * * * *